US011218797B2

(12) United States Patent
Prokisch et al.

(10) Patent No.: US 11,218,797 B2
(45) Date of Patent: Jan. 4, 2022

(54) OPPOSING LOUDSPEAKER ARRANGEMENT

(71) Applicant: Harman Becker Automotive Systems GmbH, Karlsbad (DE)

(72) Inventors: Joerg Prokisch, Schwarzach (DE); Michael Schuster, Munich (DE); Andreas Pfeffer, Wenzenbach (DE); Manfred Aigner, Deggendorf (DE)

(73) Assignee: Harman Becker Automotive Systems GmbH

( * ) Notice: Subject to any disclaimer, the term of this patent is extended or adjusted under 35 U.S.C. 154(b) by 0 days.

(21) Appl. No.: 16/830,589

(22) Filed: Mar. 26, 2020

(65) Prior Publication Data

US 2020/0329301 A1 Oct. 15, 2020

(30) Foreign Application Priority Data

Apr. 15, 2019 (EP) ..... 19169138

(51) Int. Cl.
*H04R 1/28* (2006.01)
*H04R 1/02* (2006.01)
*H04R 31/00* (2006.01)

(52) U.S. Cl.
CPC ..... *H04R 1/2803* (2013.01); *H04R 1/02* (2013.01); *H04R 1/2834* (2013.01); *H04R 31/006* (2013.01); *H04R 2201/02* (2013.01); *H04R 2499/13* (2013.01)

(58) Field of Classification Search
CPC ... H04R 1/00; H04R 1/02; H04R 1/20; H04R 1/22; H04R 1/227; H04R 1/24; H04R 1/26; H04R 1/2869; H04R 1/2873; H04R 1/2876; H04R 1/288; H04R 1/2884; H04R 1/2888; H04R 1/2892; H04R 1/2896; H04R 9/063; H04R 2201/00; H04R 2201/02; H04R 2201/029; H04R 2209/00; H04R 2209/026; H04R 2209/027; H04R 2400/00
See application file for complete search history.

(56) References Cited

U.S. PATENT DOCUMENTS

| | | | | |
|---|---|---|---|---|
| 4,805,221 | A * | 2/1989 | Quaas | H04R 1/02 181/166 |
| 5,109,422 | A * | 4/1992 | Furukawa | H04R 1/023 181/160 |
| 5,561,717 | A | 10/1996 | Lamm | |
| 6,009,972 | A * | 1/2000 | Choi | H04R 1/345 181/153 |
| 6,219,426 | B1 | 4/2001 | Daniels | |
| 2012/0008813 | A1 | 1/2012 | Rosen | |
| 2012/0219171 | A1 | 8/2012 | Velican | |
| 2016/0353198 | A1* | 12/2016 | Sahyoun | H04R 1/2834 |
| 2019/0215588 | A1* | 7/2019 | Morisaki | H04R 9/06 |

* cited by examiner

*Primary Examiner* — Walter F Briney, III
(74) *Attorney, Agent, or Firm* — Angela M. Brunetti

(57) ABSTRACT

A loudspeaker arrangement having a first loudspeaker comprising a first sound radiating surface and a first loudspeaker basket, and a second loudspeaker comprising a second sound radiating surface and a second loudspeaker basket. The first loudspeaker and the second loudspeaker are arranged opposite each other in a first direction, a cavity is formed between a front side of the first loudspeaker and a front side of the second loudspeaker, and the first loudspeaker basket is directly coupled to the second loudspeaker basket.

14 Claims, 7 Drawing Sheets

OPPOSING LOUDSPEAKER ARRANGEMENT

CROSS-REFERENCE

Priority is claimed to application Ser. No. 19/169,138.5, filed Apr. 15, 2019 in Europe, the disclosure of which is incorporated in its entirety by reference.

TECHNICAL FIELD

The disclosure relates to a loudspeaker arrangement, in particular to a loudspeaker arrangement within a housing.

BACKGROUND

Loudspeaker arrangements usually comprise a plurality of different components. A loudspeaker enclosure usually accommodates one or more loudspeakers. The loudspeaker enclosure may be mounted to a wall or, e.g., to a panel in a passenger compartment of a vehicle. The loudspeaker enclosure often is screwed to a wall or a panel, for example. Due to the movement of the loudspeaker membranes, magnets, or any other movable elements within a loudspeaker, other elements such as a loudspeaker enclosure may also be excited and vibrate. Further, different parts and elements of the loudspeaker arrangement may be excited and bump or grate against each other. Vibrations of the loudspeaker arrangement may further be transferred to other parts and elements that are directly or indirectly connected to the loudspeaker arrangement such as, e.g., wall panels or other elements that are arranged close to the loudspeaker arrangement in a vehicle. This may result in unwanted noise which may worsen the sound experience for a user.

SUMMARY

A loudspeaker arrangement includes a first loudspeaker including a first sound radiating surface and a first loudspeaker basket, and a second loudspeaker including a second sound radiating surface and a second loudspeaker basket. The first loudspeaker and the second loudspeaker are arranged opposite each other in a first direction, a cavity is formed between a front side of the first loudspeaker and a front side of the second loudspeaker, and the first loudspeaker basket is directly coupled to the second loudspeaker basket.

Other systems, methods, features and advantages will be or will become apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The arrangement may be better understood with reference to the following description and drawings. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
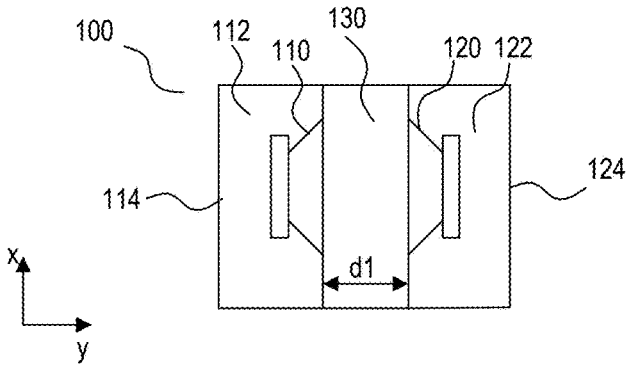
FIG. 1 schematically illustrates a cross-sectional view of a loudspeaker arrangement.

Referring to FIG. 1, a loudspeaker arrangement 100 is schematically illustrated. In particular, FIG. 1 schematically illustrates a cross-sectional view of a loudspeaker arrangement 100. The loudspeaker arrangement 100 comprises a first loudspeaker 110 and a second loudspeaker 120. The first loudspeaker 110 comprises a first sound radiating surface (e.g., a first membrane), and the second loudspeaker 120 comprises a second sound radiating surface (e.g., a second membrane). The first loudspeaker 110 and the second loudspeaker 120 are arranged opposite each other in a first direction y. That is, a first side of the first sound radiating surface is arranged opposite to and faces a first side of the second sound radiating surface. The first sound radiating surface is arranged essentially parallel to the second sound radiating surface. A distance d1 between the first loudspeaker 110 and the second loudspeaker 120 may be between 1 cm and 20 cm, for example. The distance d1 between the first loudspeaker 110 and the second loudspeaker 120 may depend on the size of the loudspeakers 110, 120, for example.

A first cavity 130 is formed between a front side of the first loudspeaker 110 and a front side of the second loudspeaker 120. The first loudspeaker 110 and the second loudspeaker 120 may radiate sound into the first cavity 130. The first cavity 130 may comprise an opening through which sound generated by the first loudspeaker 110 and sound generated by the second loudspeaker 120 may exit the first cavity 130 towards the environment. Such an opening, however, is not specifically illustrated in the cross-sectional view of FIG. 1.

The loudspeaker arrangement 100 may further comprise an enclosure comprising a first enclosure part 114 and a second enclosure part 124. The first enclosure part 114 forms a first sealed cavity 112 surrounding a back side of the first loudspeaker 110. The second enclosure part 124 forms a second sealed cavity 122 surrounding the back side of the second loudspeaker 120.

Figure 2:
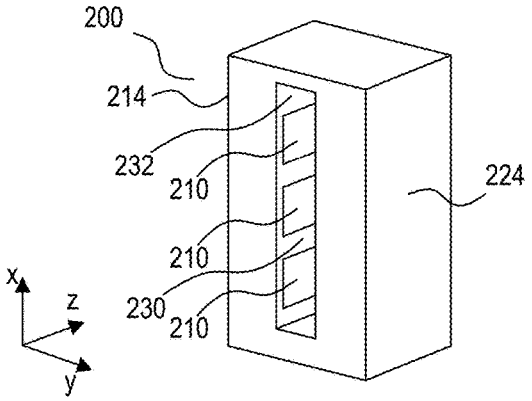
FIG. 2 schematically illustrates a dimensional view of another loudspeaker arrangement.

The loudspeaker arrangement 100 may, e.g., be mounted into a wall or in a vehicle. The loudspeaker arrangement 100 illustrated in FIG. 1 comprises one pair of loudspeakers, the pair of loudspeakers including the first loudspeaker 110 and the second loudspeaker 120. This, however, is only an example. It is also possible that a loudspeaker arrangement comprises more than one pair of loudspeakers. This is exemplarily illustrated in FIG. 2 which schematically illustrates a dimensional view of a loudspeaker arrangement 200. The loudspeaker arrangement 200 illustrated in FIG. 2 comprises three pairs of loudspeakers, each pair of loudspeakers formed by a first loudspeaker 210 and a second loudspeaker (not visible in the dimensional view of FIG. 2). Any other number of loudspeaker pairs, however, is also possible.

Each pair of loudspeakers may be arranged similarly to what has been described with respect to the loudspeaker pair of FIG. 1 above. The first cavity 230 may be formed continuously between all pairs of loudspeakers, for example. The first enclosure part 214 may enclose all first loudspeakers 210 and form a continuous closed cavity at the back side of the first loudspeakers 210. However, it is also possible that a separate closed cavity is formed at the back side of each of the first loudspeakers 210. The same applies for the second loudspeakers and the second enclosure part 224, which may form a single continuous closed cavity at the back side of the second loudspeakers, or separate closed cavities for each of the second loudspeakers. The opening 232 of the first cavity 230 may face towards a second direction z which is perpendicular to the first direction y. If the loudspeaker arrangement 200 comprises two or more pairs of loudspeakers, the pairs of loudspeakers may be arranged successively in a third direction x, which is perpendicular to both the first direction y and the second direction z.

Figure 3:
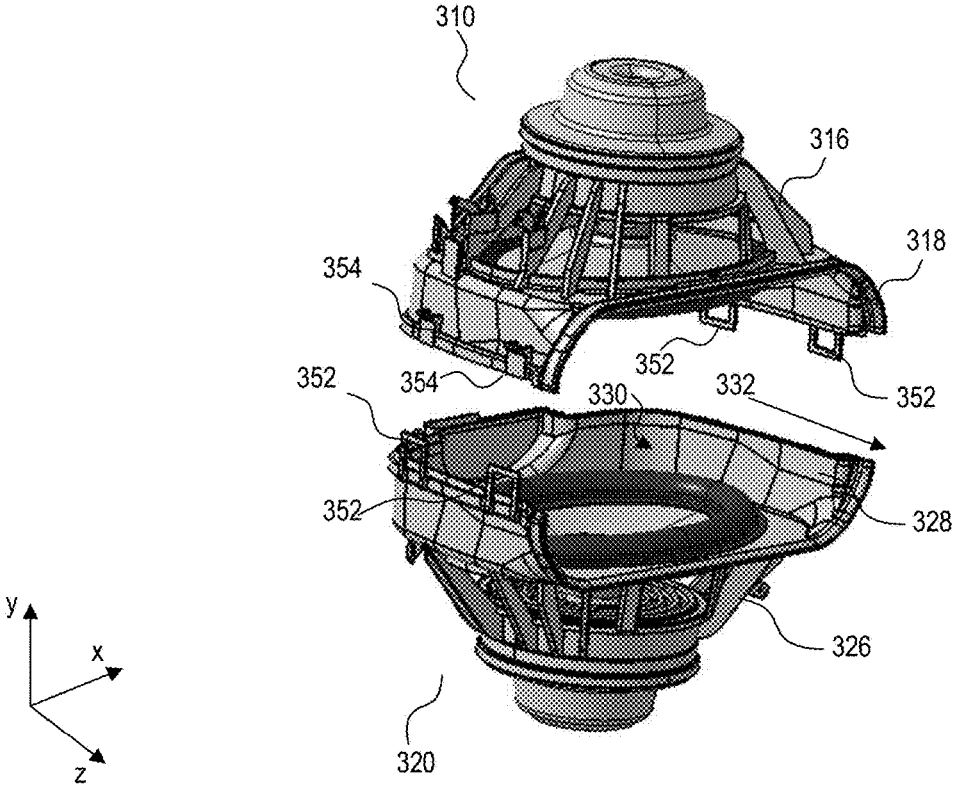
FIG. 3 schematically illustrates a dimensional view of loudspeakers of a loudspeaker arrangement in an unmounted state.

Now referring to the exploded view of FIG. 3, a first loudspeaker 310 and a second loudspeaker 320 are schematically illustrated in an unmounted state. A loudspeaker enclosure is not specifically illustrated in FIG. 3. The first loudspeaker 310 comprises a first loudspeaker basket 316, and the second loudspeaker comprises a second loudspeaker basket 326. According to one example, the first loudspeaker 310 and the second loudspeaker 320 may be arranged opposite each other in the first direction y and may be coupled to each other by means of first and second connection elements 352, 354. For example, the first loudspeaker 310 may comprise a plurality of first connection elements 352 and a plurality of second connection elements 354. The second loudspeaker 320 may also comprise a plurality of first connection elements 352 and a plurality of second connection elements 354, wherein each first connection element 352 of the second loudspeaker 320 forms a counterpart for a second connection element 354 of the first loudspeaker 310, and each second connection element 354 of the second loudspeaker 320 forms a counterpart for a first connection element 352 of the first loudspeaker 310. The first loudspeaker 310 may comprise a first projection 318. The first projection 318 may extend from the first loudspeaker basket 316 in the first direction y towards the second loudspeaker 320. The first projection 318, in a plane defined by the second direction z and the third direction x, may at least partly surround the first sound radiating surface. As is schematically illustrated in FIG. 3, the first projection 318 may be omitted towards one side, in order to form the opening 332. The second loudspeaker 320 may comprise a second projection 328. The second projection 328 may extend from the second loudspeaker basket 326 in the first direction y towards the first loudspeaker 310. The second projection 328, in a plane defined by the second direction z and the third direction x, may at least partly surround the second sound radiating surface. As is schematically illustrated in FIG. 3, the second projection 328 may be omitted towards one side, in order to form the opening 332. The first connection elements 352 and the second connection elements 354 may be arranged along the first projection 318 and the second projection 328, respectively. When the first loudspeaker 310 and the second loudspeaker 320 are coupled to each other, the first projection 318 and the second projection 328 may be coupled to each other, thereby connecting the first loudspeaker basket 316 to the second loudspeaker basket 326. The first cavity 330 may be defined by the first and the second projection 318, 328. That is, the first and the second projection 318, 328 partially surround the first cavity 330 in a plane defined by the second direction z and the third direction x.

According to one example, when the first loudspeaker 310 and the second loudspeaker 320 are mounted together (interconnected), each first counterpart 352 may engage with (e.g., snap into) one of the second counterparts 354 of the opposite loudspeaker 310, 320. This, however, is only an example. The first and second connection elements 352, 354, may be implemented in any suitable way and may comprise, e.g., brackets, pins, pressfit-pins, bolts, or screws. Any other suitable first and second connection elements 352, 354 are also possible. When a connection is formed between the first loudspeaker 310 and the second loudspeaker 320, the first cavity 330 is formed between the first loudspeaker 310 and the second loudspeaker 320, with an opening 332 formed towards the second direction z.

The first loudspeaker 310 and the second loudspeaker 320 during use (e.g., when the first sound radiating surface and the second sound radiating surface are excited in order to produce sound) both generate vibrations. By directly connecting the first loudspeaker basket 316 to the second loudspeaker basket 326, the vibrations of the two loudspeakers 310, 320 cancel each other out. That is because both loudspeakers 310, 320 generally receive the same sound signal and produce the same sound at the same time. That is, both loudspeakers vibrate simultaneously. By mounting the loudspeakers to face each other, the vibrations are inverse to each other and, therefore, counteract each other. In this way, the resulting vibrations of the loudspeaker arrangement 300 comprising the first loudspeaker 310 and the second loudspeaker 320, are zero or at least close to zero. Therefore, almost zero vibration is transferred to any surround parts such as a loudspeaker enclosure, for example.

Figure 4:
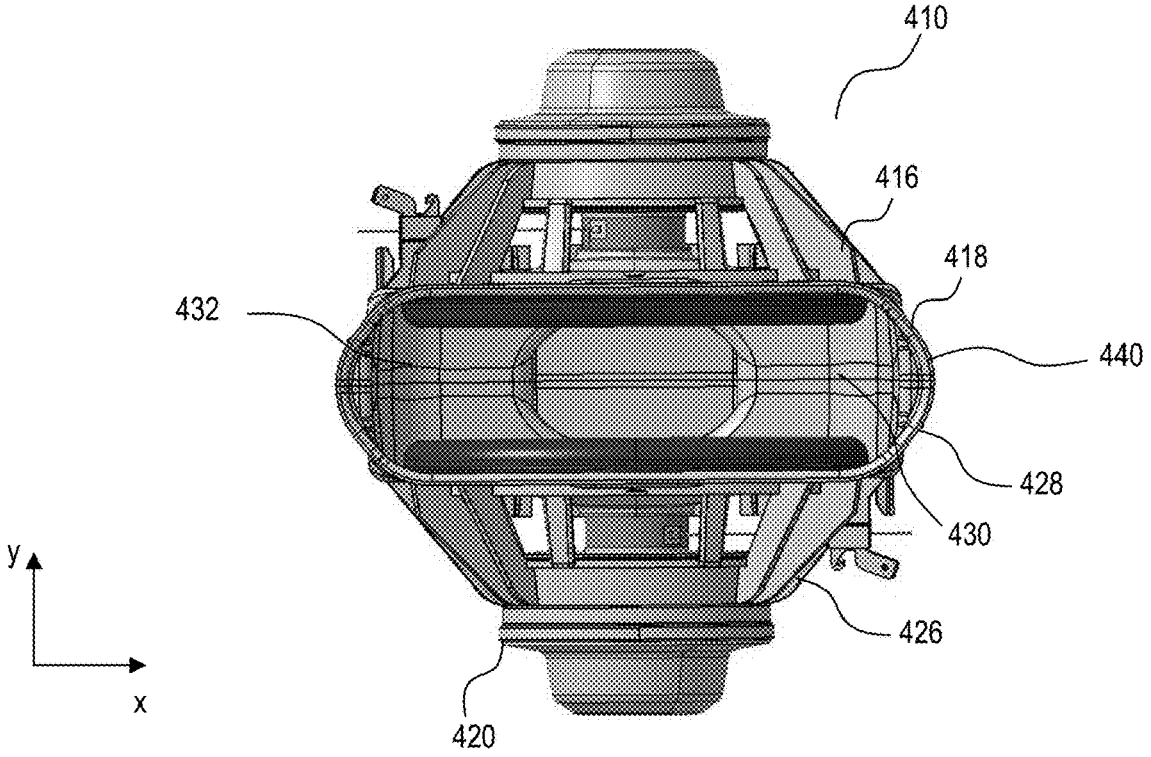
FIG. 4 schematically illustrates a front view of loudspeakers of an exemplary loudspeaker arrangement.
Figure 5:
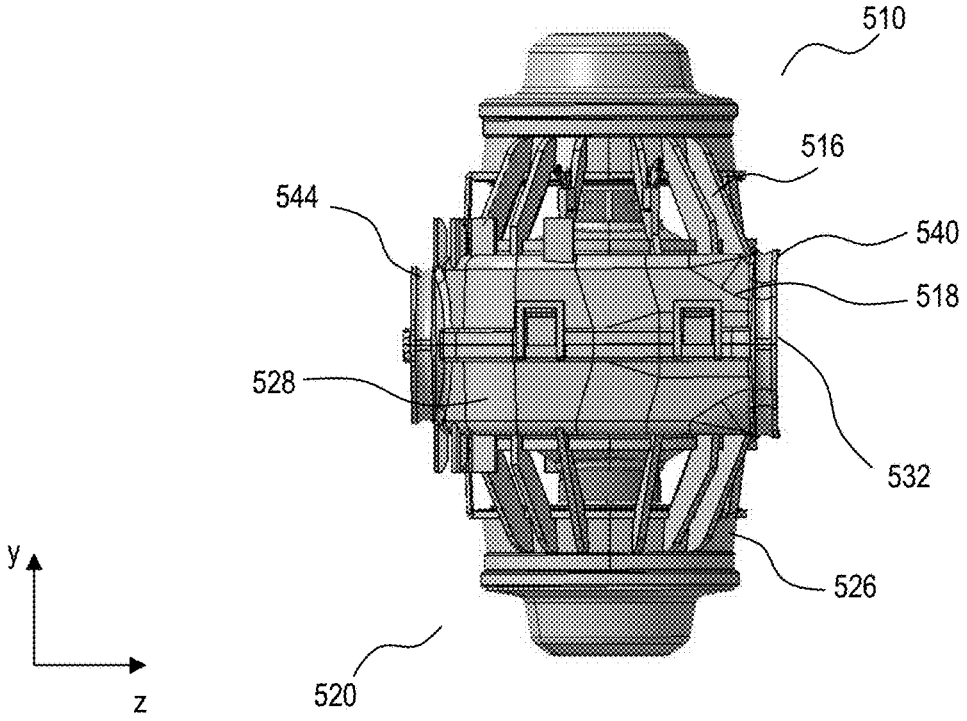
FIG. 5 schematically illustrates a side view of loudspeakers of an exemplary loudspeaker arrangement.

A first loudspeaker 410 and a second loudspeaker 420 in a mounted state are exemplarily illustrated in the front view of FIG. 4 and in the side view of FIG. 5. As can be seen in the side view of FIG. 5 for example, when the first loudspeaker 510 is connected to the second loudspeaker 520, a third projection 540 and a fourth projection 544 are formed by the first loudspeaker 510 and the second loudspeaker 520. The third projection 540 extends from the loudspeaker arrangement 500 in the second direction z, and the fourth projection 544 extends from the loudspeaker arrangement 500 in the second direction z, opposite to the first projection 540. According to one example, the third projection 540 may be formed by the first loudspeaker basket 516 or the first projection 518 and the second loudspeaker basket 526 or the second projection 528, and the fourth projection 544 may also be formed by the first loudspeaker basket 516 or the first projection 518 and by the second loudspeaker basket 526 or the second projection 528. For example, an upper half of the third projection 540 and an upper half of the fourth projection 544 may be formed by the first loudspeaker 510 (first loudspeaker basket 516 or first projection 518), and a lower half of the third projection 540 and a lower half of the fourth projection 544 may be formed by the second loudspeaker 520 (second loudspeaker basket 526 or second projection 528).

Each of the third projection 440, 540 and the fourth projection (not shown in FIG. 4), 544 may comprise a protruding edge or ledge, for example. The third projection 440, 540 may surround the opening 432 of the first cavity 430 in a plane defined by the second and third direction z, x, for example. As is schematically illustrated in FIG. 4, the opening 432 may have an elongated form (cross-section), e.g., rectangular with rounded corners. Any other form (cross-section) of the opening 432, however, is also possible such as, square, rectangular, rounded, or oval, for example. Again referring to FIG. 5, the fourth projection 544 may be arranged opposite to the third projection 540 in the second direction z. That is, the fourth projection 544 may be arranged at a rear wall of the first cavity 530 and the third projection 540 may be arranged at the front of the first cavity 530, for example. This, however, is only an example. According to another example (not illustrated), the third projection 540 may be arranged at a first side wall of the first cavity 530 and the fourth projection 544 may be arranged at a second side wall of the first cavity 430, for example. In the latter case, however, the third projection 540 may not surround the opening 532 of the first cavity 530.

Figure 6:
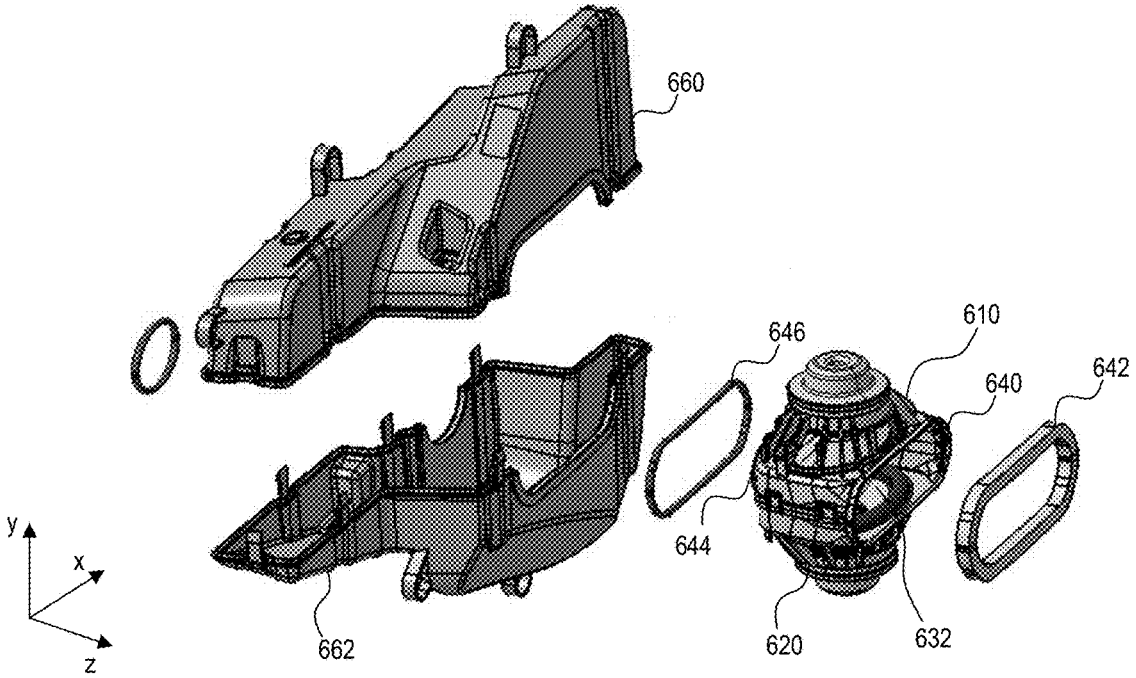
FIG. 6 schematically illustrates an exploded view of an exemplary loudspeaker arrangement in an unmounted state.
Figure 7A:
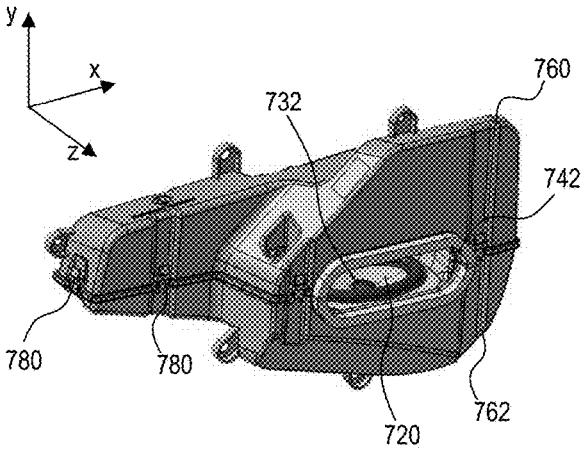
FIGS. 7A, 7B and 7C, schematically illustrate a dimensional view, a front view and a side view of an exemplary loudspeaker arrangement in a mounted condition.
Figure 7B:
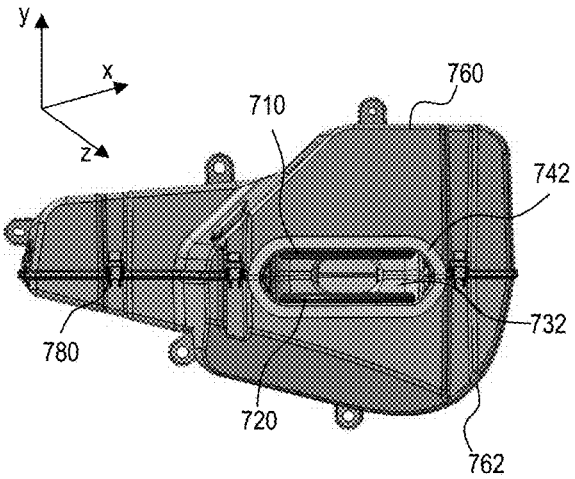
Figure 7C:
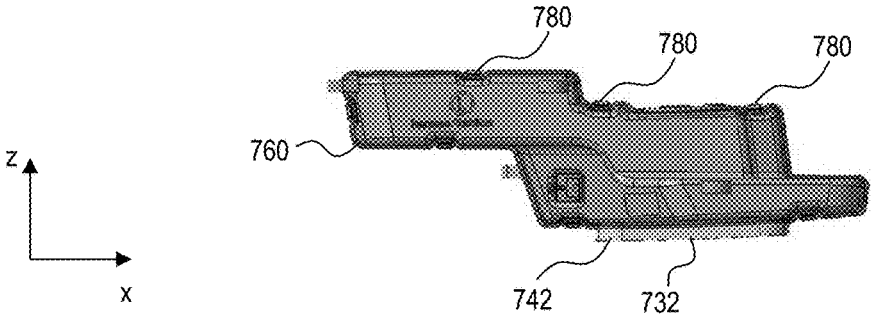

Now referring to FIG. 6, an exploded view of a loudspeaker arrangement comprising a first loudspeaker 610, a second loudspeaker 620, a first enclosure part 660 and a second enclosure part 662 is schematically illustrated. When fully assembled, the first enclosure part 660 may be arranged to enclose the first loudspeaker 610 and the second enclosure part 662 may be arranged to enclose the second loudspeaker 620. FIG. 7 schematically illustrates the loudspeaker arrangement in a mounted state, with FIG. 7A illustrating a dimensional view and FIG. 7B illustrating a front view of the loudspeaker arrangement 700. FIG. 7C schematically illustrates a side view of the exemplary loudspeaker arrangement 700. In FIG. 7A, the second loudspeaker 720 is visible through the opening 732, while the first loudspeaker 710 is concealed by the first enclosure part 760. In FIG. 7B, the front side of the first loudspeaker 710 and the front side of the second loudspeaker 720 are visible through the opening 732. The loudspeaker enclosure 600, 700 comprising the first enclosure part 660, 760 and the second enclosure part 662, 762 in FIGS. 6 and 7 is formed to fit into the interior of a vehicle. The general form of the enclosure and the individual enclosure parts 660, 760, 662, 762, however, may vary, depending on whether the loudspeaker arrangement is arranged inside a vehicle, depending on which kind of vehicle the loudspeaker enclosure is arranged in, and depending on the position of the loudspeaker arrangement inside a vehicle, e.g., front part of the passenger compartment, rear part of the passenger compartment, trunk, etc.

As is illustrated in FIGS. 6 and 7, a first elastic cord 642, 742 may be arranged on the third projection 640, 740 and a second elastic cord 646 (not visible in FIG. 7) may be arranged on the fourth projection 644, for example. That is, the first elastic cord 642, 742 may be arranged to surround the third projection 640 and the second elastic cord 646 may be arranged to surround the fourth projection 644. The elastic cords 642, 742, 646 may surround the projections 640, 740, 644 like a tire surrounds a rim, for example.

When the enclosure parts 760, 762 are arranged to surround the loudspeakers 710, 720, the third projection 740 and the fourth projection may be clamped between the first enclosure part 760 and the second enclosure part 762.

Figure 13:
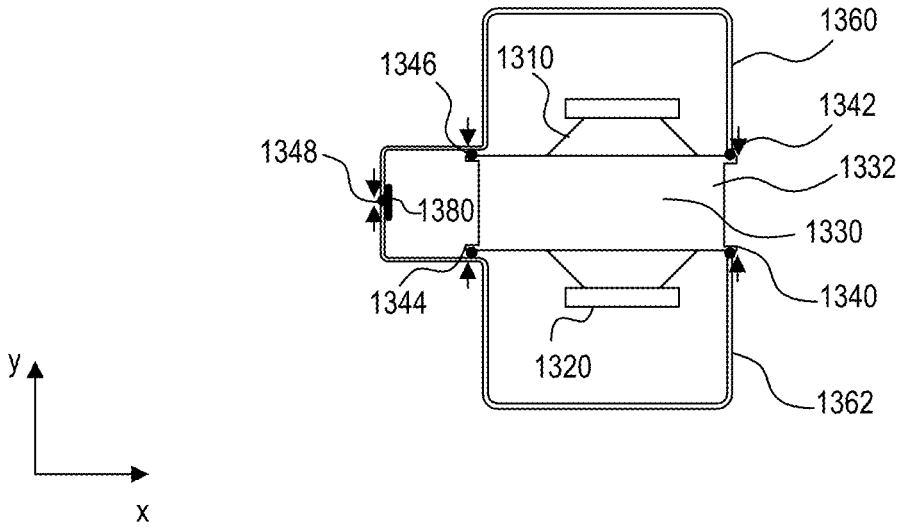
FIG. 13 schematically illustrates a cross-sectional view of an exemplary loudspeaker arrangement.

This is exemplarily illustrated in more detail in the cross-sectional view of FIG. 13. The first enclosure part 1360 and the second enclosure part 1362 when arranged to enclose the first loudspeaker 1310 and the second loudspeaker 1320, may form a first circumferential connection area arranged to surround and clamp the third projection 1340, and a second circumferential connection area arranged to surround and clamp the fourth projection 1344 such that the third projection 1340 and the fourth projection 1344 each are clamped between the first enclosure part 1360 and the second enclosure part 1362. In this way, the first loudspeaker 1310 and the second loudspeaker 1320 may be fixed inside the enclosure. No further points of contact between the loudspeakers 1310, 1320 and the enclosure are generally necessary. That is, the first loudspeaker 1310 and the second loudspeaker 1320 may be fixed inside the enclosure solely by clamping the third projection 1340 and the fourth projection 1344 between the first enclosure part 1360 and the second enclosure part 1362. In this way, the first loudspeaker 1310 and the second loudspeaker 1320 may be mechanically decoupled from the first enclosure part 1310 and the second enclosure part 1320.

Still referring to FIG. 13, and as has been described above (see also FIG. 3), most if not all vibrations generated during use of the loudspeakers 1310, 1320 are cancelled out by directly connecting the first loudspeaker 1310 (first loudspeaker basket, not specifically illustrated in FIG. 13) to the second loudspeaker 1320 (second loudspeaker basket, not specifically illustrated in FIG. 13). Any potentially remaining vibrations generated by the loudspeakers 1310, 1320 that are not cancelled out by directly connecting the first loudspeaker 1310 to the second loudspeaker 1320 may be at least partly damped or absorbed by suspending the loudspeakers 1310, 1320 within the loudspeaker enclosure (e.g., between first enclosure part 1360 and second enclosure part 1362), as has been described above with respect to FIG. 13.

Further, in the exemplary arrangement, the use of screws for fixing the loudspeakers 1310, 1320 inside the enclosure may be entirely avoided. In conventional arrangements, screws may become loose over time, as the material of the screws (e.g., metal) usually has a different thermal expansion coefficient than the material of the loudspeakers 1310, 1320 (e.g. plastic or glass fiber) and the material of the enclosure (e.g., plastic or glass fiber). The loosening of the screws may lead to unwanted clattering and rattling of the loudspeaker arrangement. Any unwanted noise and clattering may be avoided when fixing the loudspeakers 1310, 1320 inside the enclosure by clamping the third projection 1340 and the fourth projection 1344 between the first enclosure part 1360 and the second enclosure part 1362.

If an elastic cord 1342, 1346 is arranged between a projection 1340, 1344 and the enclosure parts 1360, 1362, any vibrations or excitations of the loudspeakers 1310, 1320 may be damped further, for example. Vibrations of the first and second loudspeakers 1310, 1320, therefore, may be completely, or at least almost completely, reduced or avoided. Suspending the loudspeakers 1310, 1320 between the first enclosure part 1360 and the second enclosure part 1362, stiffens (strengthens) the enclosure walls, while at the same time dampening any remaining vibrations. Further, the inside of the enclosure may be sealed towards the outside by means of elastic cords 1342, 1346. The first elastic cord 1342 may be arranged between the third projection 1340 and the first and second enclosure parts 1360, 1362, and the second elastic cord 1346 may be arranged between the fourth projection 1344 and the first and second enclosure parts 1360, 1362.

Figure 12A:
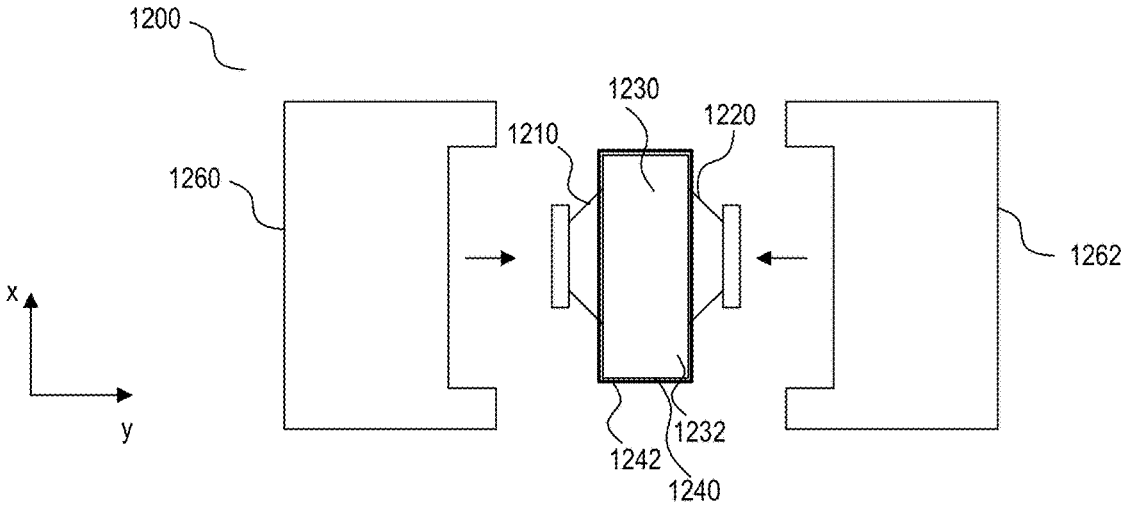
FIGS. 12A and 12B schematically illustrate a side view of an exemplary loudspeaker arrangement in an unmounted and in a mounted state.
Figure 12B:
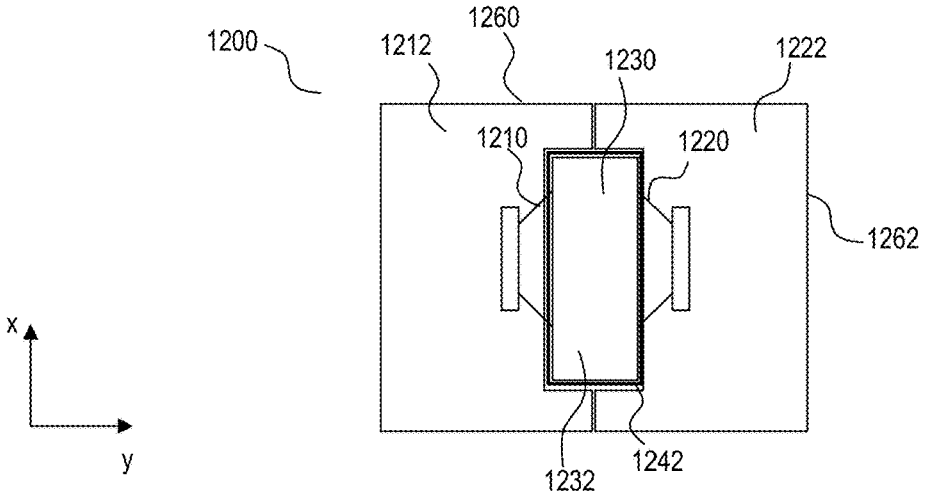

Now referring to the front views of FIGS. 12A and 12B, the basic principle of an exemplary loudspeaker arrangement 1200 is further illustrated. FIG. 12A illustrates a front view of a loudspeaker arrangement in an unmounted state, and FIG. 12B illustrates a front view of the loudspeaker arrangement in a mounted state. The first loudspeaker 1210 and the second loudspeaker 1220 are arranged opposite each other and a first cavity 1230 is formed between the front side of the first loudspeaker 1210 and the front side of the second loudspeaker 1220. The first enclosure part 1260 and the second enclosure part 1262 each may have a recess which forms the first circumferential connection area for clamping the third projection 1240. A second circumferential connection area for clamping the fourth projection as well as the fourth projection itself are not visible in the front view of FIGS. 12A and 12B.

When the first enclosure part 1260 and the second enclosure part 1262 are arranged to enclose the first loudspeaker 1210 and the second loudspeaker 1220, the first enclosure part 1260 may be fixed to the second enclosure part 1262. According to one example, the first enclosure part 1260 may be glued to the second enclosure part 1262 in the mounted state. For example, a (viscoplastic) adhesive or glue may be applied between the first enclosure part 1260 and the second enclosure part 1262. More specifically, an adhesive or glue may be applied along a contact surface or contact area of the first enclosure part 1260 which is brought into contact with a contact surface or contact area of the second enclosure part 1262. This, however, is only an example.

Figure 8:
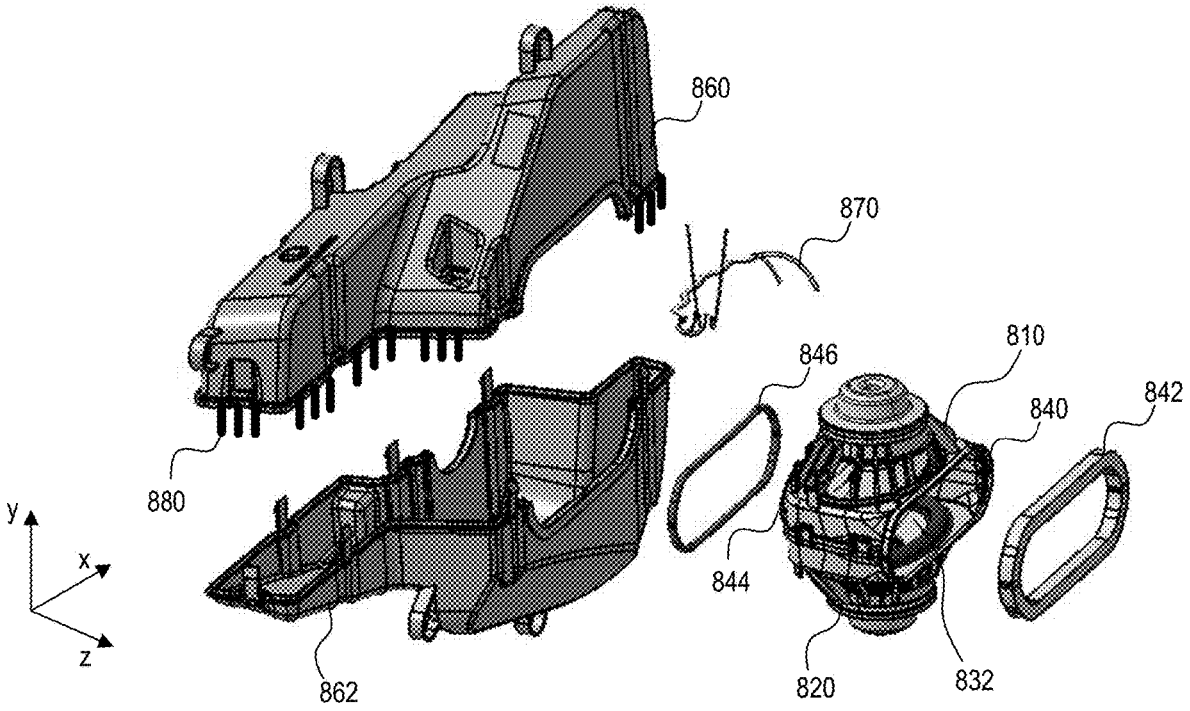
FIG. 8 schematically illustrates an exploded view of another exemplary loudspeaker arrangement in an unmounted state.

Now referring to the exploded view of FIG. 8, the loudspeaker arrangement may further include third connection elements 880 that are configured to connect the first enclosure part 860 to the second enclosure part 862. A plurality of third connection elements 880 are schematically illustrated in FIG. 8. Each of the plurality of third connection elements 880 may comprise a screw, a bolt, a bracket, a pin, a hook, or a press-fit pin, for example. One example of a third connection element 880 will be described with respect to FIG. 10 in more detail below. The plurality of third connection elements 880 may be evenly distributed around the enclosure and along the contact area between the first enclosure part 860 and the second enclosure part 862 to equally distribute the resulting holding force along the perimeter of the enclosure.

Figure 9:
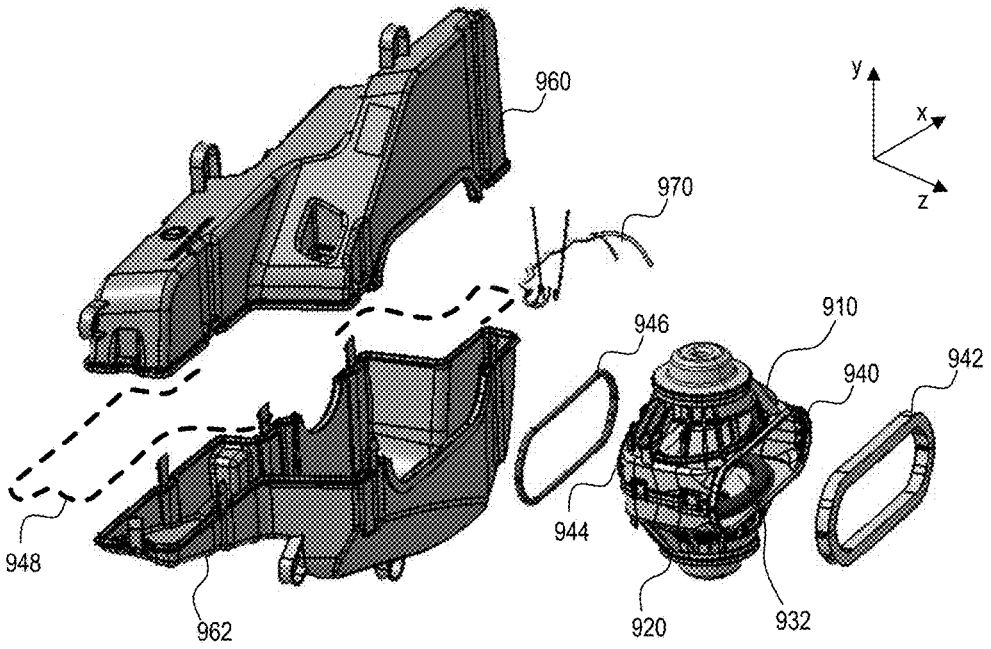
FIG. 9 schematically illustrates an exploded view of another exemplary loudspeaker arrangement in an unmounted state.

Now referring to FIG. 9, a third elastic cord 948 (illustrated in dashed lines in FIG. 9) may be arranged between the first enclosure part 960 and the second enclosure part 962. In this way, the inside of the enclosure may be further sealed towards the outside. Even further, vibrations and excitations may be further reduced. A third elastic cord 948 may be used instead of an adhesive or glue as has been described with respect to FIG. 8 above.

According to one example, the first enclosure part 960 and the second enclosure part 962 each include a material such as polypropylene or glass fiber, for example. The first elastic cord 942, the second elastic cord 946 and the third elastic cord 948 each may comprise an elastic material that may be compacted or compressed up to a maximum of 50% of its original volume (original volume= when no pressure is exerted on the elastic cord). The first, second, and third elastic cords 942, 946, 948 each may comprise an elastomer, sponge or foam rubber, or any other foam material, for example.

The first loudspeaker 810, 910 and the second loudspeaker 820, 920 may be electrically coupled to components or elements arranged outside the enclosure, e.g., to a power supply such as a vehicle battery. A cable harness 870, 970 for electrically coupling the first loudspeaker 810, 910 and the second loudspeaker 820, 920 to the outside of the enclosure is exemplarily illustrated in FIGS. 8 and 9. The enclosure may comprise a further opening (not specifically illustrated) through which such a cable harness 870, 970 may extend from the inside to the outside of the enclosure.

Figure 10A:
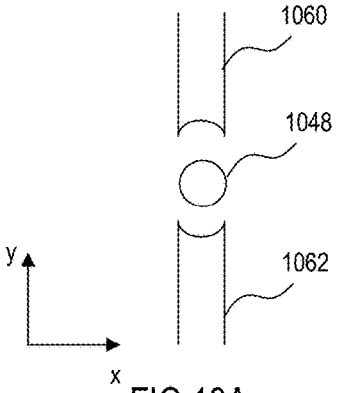
FIGS. 10A, 10B and 10C schematically illustrate a cross-sectional view of a section of the enclosure walls of a loudspeaker arrangement and of an exemplary connection element in a mounted an in an unmounted state.
Figure 10B:
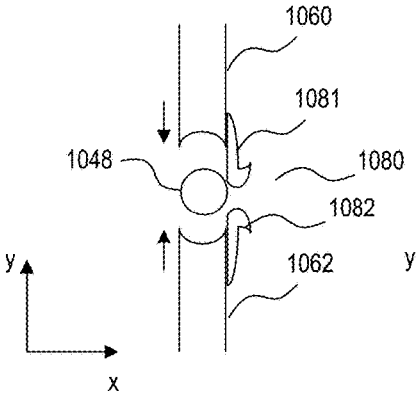
Figure 10C:
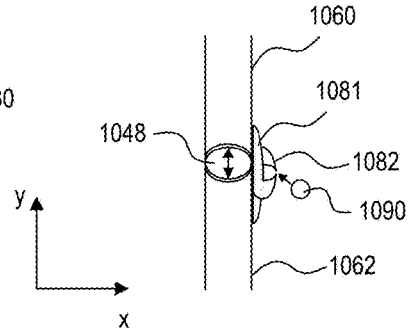

Now referring to the cross-sections of FIGS. 10A, 10B and 10C, a third connection element 1080 according to one example is described in further detail. FIG. 10A schematically illustrates a section of the first enclosure part 1060 and a section of the second enclosure part 1062. The third elastic cord 1048 is arranged between the first enclosure part 1060 and the second enclosure part 1062. FIG. 10A illustrates the first enclosure part 1060 and the second enclosure part 1062 in an unmounted state and without a third connection element. FIG. 10B illustrates the same arrangement as FIG. 10A, further comprising a third connection element 1080. The third connection element 1080 may comprise a first hook 1081 and a second hook 1082. The first hook 1081 may be coupled to the first enclosure part 1060 and the second hook 1082 may be coupled to the second enclosure part 1062. FIG. 10B also illustrates the arrangement in an unmounted state. The arrows in FIG. 10B indicate the direction in which the enclosure parts 1060, 1062 are moved towards each other when connecting the first enclosure part 1060 to the second enclosure part 1062.

FIG. 10C illustrates the arrangement when the first enclosure part 1060 is pressed towards the second enclosure part 1062. This results in the third elastic cord 1048 being compressed. The first hook 1081 and the second hook 1082 in the mounted state may overlap in the first direction y. A fixing element 1090 may be inserted between the first hook 1081 and the second hook 1082. This is indicated by a small arrow in FIG. 10C. When the first fixing element 1090 is inserted between the first hook 1081 and the second hook 1082, it fixes the first hook 1081 with regard to the second hook 1082 and thereby prevents the removal of the first enclosure part 1060 from the second enclosure part 1062. The third elastic cord 1048 exerts an expansion pressure on the first enclosure part 1060 and on the second enclosure part 1062, wherein this expansion pressure would push the first enclosure part 1060 away from the second enclosure part 1062 without the third connection element 1080. However, the third connection element 1080, e.g., the hooks 1081, 1082 with the fixing element 1090 arranged therebetween, prevents the first enclosure part 1060 from being pushed away from the second enclosure part 1062. That is, the third connection element 1080 counteracts the expansion pressure of the compressed third elastic cord 1048 and keeps the first enclosure part 1060 and the second enclosure part 1062 firmly pressed against each other. The expansion force exerted by the third elastic cord 1048, on the other hand, forces the hooks 1081, 1082 to move towards each other such that the fixing element 1090 is firmly clamped between the first hook 1081 and the second hook 1082.

As is exemplarily illustrated in FIG. 10, the first enclosure part 1060 and the second enclosure part 1062 each may comprise a notch or an indentation to receive the third elastic cord 1048. In this way, the third elastic cord 1048 may be prevented from slipping out from between the first enclosure part 1060 and the second enclosure part 1062.

As is implied in FIG. 5, for example, the third projection 540 and the fourth projection 544, optionally, may also comprise a notch or an indentation to receive the first elastic cord 542 and the second elastic cord 546, respectively, and to prevent the elastic cords 542, 546 from slipping off the projections 540, 544.

Figure 11A:
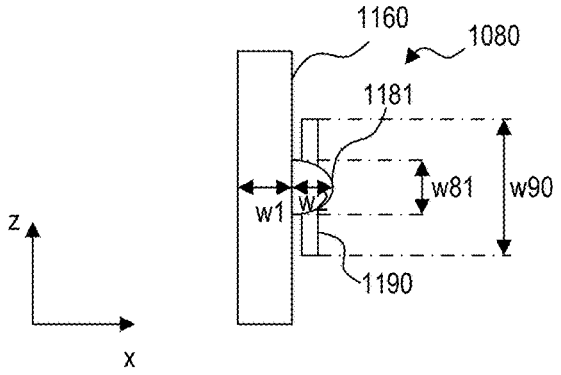
FIGS. 11A and 11B schematically illustrate cross-sectional views of an exemplary connection element in a mounted state.
Figure 11B:
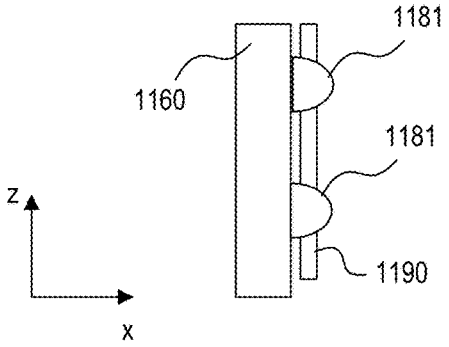

Now referring to FIG. 11A, a top view of a third connection element 1080 is exemplarily illustrated. In the cross-sectional view of FIG. 11A, the first enclosure part 1160 is visible as well as the first hook 1181. The second hook is concealed by the first hook 1181 in this top view as it is arranged below the first hook 1181 in the first direction y (extending vertically into the image plane in the top view of FIG. 11A). The fixing element 1190 may have a width w90 in the second direction z that is greater than a width w81 of the first hook 1181 and the second hook in the same direction z. This may prevent the fixing element 1190 from slipping out from between the first hook 1181 and the second hook in the second direction z. According to the example illustrated in FIG. 11A, a separate fixing element 1190 may be provided for each pair of hooks. This, however, is only an example. According to another example, one fixing element 1190 may extend along two or more pairs of hooks 1181. This is exemplarily illustrated in FIG. 11B.

As is further illustrated in FIG. 11A, a thickness w1 of the first enclosure part 1160 and the second enclosure part 1162 in the third direction x may be larger than a maximum extension w2 of the third connection element 1180 in the same direction x. For example, the maximum extension w2 of the third connection element 1180 may be ⅔ of the thickness w1 of the first enclosure part 1160 and the second enclosure part 1162. The maximum extension w2 of the third connection element 1180 may be 2.5 mm, for example. This, however, is only an example. The maximum extension w2 of the third connection element 1180 may also be larger or smaller than 2.5 mm.

Now referring to FIGS. 12A and 12B, a cross-sectional view of a loudspeaker arrangement 1200 is exemplarily illustrated, wherein FIG. 12A illustrates the loudspeaker arrangement 1200 in an unmounted state and FIG. 12B illustrates the loudspeaker arrangement 1200 in a mounted state. The first loudspeaker 1210 and the second loudspeaker 1220 are arranged opposite each other in the first direction y, as has been described above. A first cavity 1230 is formed between the first loudspeaker 1210 and the second loudspeaker 1220. Opening 1232 of the first cavity 1230 faces in the second direction, z. A first enclosure part 1260 and a second enclosure part 1262 are arranged to enclose the first loudspeaker 1210 and the second loudspeaker 1220. In a mounted state, the first loudspeaker 1210 and the second loudspeaker 1220 are clamped between the first enclosure part 1260 and the second enclosure part 1262. In particular, the third projection 1240 and the fourth projection formed by the first loudspeaker 1210 and the second loudspeaker 1220 are clamped between the first enclosure part 1260 and the second enclosure part 1262. The first enclosure part 1260 may exert a pressure on the first loudspeaker 1210, and the second enclosure part 1262 may exert a pressure on the second loudspeaker 1220, for example, thereby pressing the first loudspeaker 1210 and the second loudspeaker 1220 towards each other. As has been described before, a first elastic cord 1242 may be arranged between the third projection 1240 and the first and the second enclosure parts 1260, 1262. The fourth projection and an optional second elastic cord are not visible in the cross-sectional view of FIG. 12.

Now referring to FIG. 13, another cross-sectional view of a loudspeaker arrangement is exemplarily illustrated. In the cross-sectional view of FIG. 13, the opening 1332 of the first cavity 1330 faces in the second direction z. In FIG. 13, both the third projection 1340 and the fourth projection 1344 are visible. A first elastic cord 1342 is arranged to surround the third projection 1340, and a second elastic cord 1346 is arranged to surround the fourth projection 1344. The arrows illustrated in FIG. 13 indicate the direction in which the first enclosure part 1360 and the second enclosure part 1362 exert a pressure on the third projection 1340 and the fourth projection 1344, respectively. Further, in FIG. 13, a third elastic cord 1348 is illustrated between the first enclosure part 1360 and the second enclosure part 1362. The loudspeaker arrangement 1300 illustrated in FIG. 13 further comprises a third connection element 1380 that is configured to connect the first enclosure part 1360 to the second enclosure part 1362.

The first, second and third direction x, y, z are used throughout the description for illustrative purposes only. The directions are not meant to be defined with regard to a ground surface. Rather, the directions are merely used to illustrate the orientation of the different elements and their arrangement with regard to each other. When mounted into a wall or inside a vehicle, the described loudspeaker arrangement may be rotated into any suitable position resulting in any suitable orientation.

While various embodiments of the invention have been described, it will be apparent to those of ordinary skill in the art that many more embodiments and implementations are possible within the scope of the invention. In particular, the skilled person will recognize the interchangeability of various features from different embodiments. Although these techniques and systems have been disclosed in the context of certain embodiments and examples, it will be understood that these techniques and systems may be extended beyond the specifically disclosed embodiments to other embodiments and/or uses and obvious modifications thereof. Accordingly, the invention is not to be restricted except in light of the attached claims and their equivalents.

The description of embodiments has been presented for purposes of illustration and description. Suitable modifications and variations to the embodiments may be performed in light of the above description or may be acquired from practicing the methods. The described arrangements are exemplary in nature and may include additional elements and/or omit elements. As used in this application, an element recited in the singular and proceeded with the word "a" or "an" should be understood as not excluding plural of said elements, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The described systems are exemplary in nature and may include additional elements and/or omit elements. The subject matter of the present disclosure includes all novel and non-obvious combinations and sub-combinations of the various systems and configurations, and other features, functions, and/or properties disclosed. The following claims particularly point out subject matter from the above disclosure that is regarded as novel and non-obvious.

What is claimed is:

1. A loudspeaker arrangement, comprising:

a first loudspeaker having a first sound radiating surface and a first loudspeaker basket;

a second loudspeaker having a second sound radiating surface and a second loudspeaker basket;

the first loudspeaker and the second loudspeaker are arranged opposite each other in a first direction;

a cavity formed between a front side of the first loudspeaker and a front side of the second loudspeaker;

the first loudspeaker basket is directly coupled to the second loudspeaker basket;

a third projection and a fourth projection formed by the first loudspeaker basket and the second loudspeaker basket, and arranged opposite each other in a second direction that is perpendicular to the first direction;

a loudspeaker enclosure comprising a first enclosure part arranged to enclose a rear side of the first loudspeaker, and a second enclosure part arranged to enclose a rear side of the second loudspeaker and to be connected to the first enclosure part and when the first enclosure part and the second enclosure part are arranged to enclose the first and the second loudspeaker, the third projection and the fourth projection each are clamped between the first enclosure part and the second enclosure part.

2. The loudspeaker arrangement of claim 1, wherein the first loudspeaker basket has a first projection extending from the first loudspeaker basket in the first direction towards the second loudspeaker;

the second loudspeaker basket has a second projection extending from the second loudspeaker basket in the first direction towards the first loudspeaker; and the first projection is directly coupled to the second projection, thereby defining the cavity between the front side of the first loudspeaker and the front side of the second loudspeaker.

3. The loudspeaker arrangement of claim 1, further comprising:

a first elastic cord mounted on the third projection to circumferentially surround the third projection;

a second elastic cord mounted on the fourth projection to circumferentially surround the fourth projection; and when the first enclosure part and the second enclosure part are arranged to enclose the first and the second loudspeakers, the first elastic cord is arranged between the third projection and the loudspeaker enclosure, and the second elastic cord is arranged between the fourth projection and the loudspeaker enclosure.

4. The loudspeaker arrangement of claim 3, wherein, when the loudspeaker enclosure is arranged to enclose the first loudspeaker and the second loudspeaker, the first enclosure part and the second enclosure part exert pressure on the first elastic cord and the third projection, and the first enclosure part and the second enclosure part further exert pressure on the second elastic cord and the fourth projection, thereby fixating the first loudspeaker and the second loudspeaker within the enclosure.

5. The loudspeaker arrangement of claim 4, wherein, when pressure is exerted on the first elastic cord, the first elastic cord is compressed up to a maximum of 50%; and when pressure is exerted on the second elastic cord, the second elastic cord is compressed up to a maximum of 50%.

6. The loudspeaker arrangement of claim 3, further comprising a third elastic cord arranged between the first enclosure part and the second enclosure part.

7. The loudspeaker arrangement of claim 6, wherein at least one of the first elastic cord comprises an elastomer, sponge or foam rubber, or a foam material;

the second elastic cord comprises an elastomer, sponge or foam rubber, or a foam material; and the third elastic cord comprises an elastomer, sponge or foam rubber, or a foam material.

8. The loudspeaker arrangement of claim 1, wherein the cavity further comprises at least one opening in the second direction towards an environment outside of the cavity.

9. The loudspeaker arrangement of claim 1, wherein the first loudspeaker and the second loudspeaker are arranged such that the first sound radiating surface and the second sound radiating surface are arranged substantially in parallel to each other.

10. The loudspeaker arrangement of claim 1, further comprising a plurality of first connection elements and a plurality of second connection elements configured to connect the first loudspeaker basket to the second loudspeaker basket.

11. The loudspeaker arrangement of claim 1, further comprising:

a plurality of first connection elements;

a plurality of second connection elements configured to connect the first loudspeaker basket to the second loudspeaker basket; and a plurality of third connection elements that are configured to connect the first enclosure part to the second enclosure part.

12. The loudspeaker arrangement of claim 11, wherein the plurality of third connection elements is evenly distributed around the loudspeaker enclosure and along a contact area between the first enclosure part and the second enclosure part to equally distribute a resulting holding force along a perimeter of the loudspeaker enclosure.

13. The loudspeaker arrangement of claim 11, wherein each of the plurality of third connection elements comprises a first hook attached to the first enclosure part, a second hook attached to the second enclosure part and a fixing element.

14. The loudspeaker arrangement of claim 13, wherein, when the first enclosure part is connected to the second enclosure part, for each of the plurality of third connection elements the respective first hook and second hook overlap in the first direction, and the fixing element is inserted between the first hook and the second hook.

* * * * *